US009163403B2

(12) United States Patent
Pacitto et al.

(10) Patent No.: US 9,163,403 B2
(45) Date of Patent: Oct. 20, 2015

(54) BLOCK FOR USE IN CONSTRUCTING A RETAINING WALL WITH IMPROVED FEATURES

(71) Applicants: Jeffrey Pacitto, Richmond Hill (CA); Jonathan Pignatelli, Richmond Hill (CA)

(72) Inventors: Jeffrey Pacitto, Richmond Hill (CA); Jonathan Pignatelli, Richmond Hill (CA)

(73) Assignee: Best Way Stone Limited, Woodbridge (CA)

( * ) Notice: Subject to any disclaimer, the term of this patent is extended or adjusted under 35 U.S.C. 154(b) by 0 days.

(21) Appl. No.: 14/210,798

(22) Filed: Mar. 14, 2014

(65) Prior Publication Data

US 2014/0270989 A1 Sep. 18, 2014

(30) Foreign Application Priority Data

Mar. 15, 2013 (CA) ..... 2809704

(51) Int. Cl.
*E02D 29/02* (2006.01)
*E04C 1/00* (2006.01)

(52) U.S. Cl.
CPC .. *E04C 1/00* (2013.01); *E02D 29/02* (2013.01)

(58) Field of Classification Search
CPC ..... E02D 29/02; E02D 29/025
USPC ..... 405/284, 286; 52/603–605
See application file for complete search history.

(56) References Cited

U.S. PATENT DOCUMENTS

| | | | | |
|---|---|---|---|---|
| 1,639,063 | A | 8/1927 | Stevens | |
| 1,872,522 | A | 8/1932 | Stuckey | |
| 2,668,435 | A | 2/1954 | Norman | |
| 3,534,518 | A | 10/1970 | Zagray | |
| 3,888,060 | A | 6/1975 | Haener | |
| 4,367,615 | A | 1/1983 | Feldman | |
| 5,598,679 | A | 2/1997 | Orton et al. | |
| 5,951,210 | A * | 9/1999 | Maguire et al. | 405/286 |
| 6,178,715 | B1 | 1/2001 | Pacitto et al. | |
| 6,398,458 | B1 | 6/2002 | Pacitto et al. | |
| 8,887,469 | B2 * | 11/2014 | MacDonald et al. | 52/608 |
| 2002/0083657 | A1 * | 7/2002 | Mattox et al. | 52/125.2 |

* cited by examiner

*Primary Examiner* — Sunil Singh
(74) *Attorney, Agent, or Firm* — Eric L. Lane; Green Patent Law

(57) ABSTRACT

A block for forming a structure, the block having a top, a bottom, a front wall, a back wall and two side walls, the block having disposed proximate the top at least one projection, the block having disposed proximate the bottom thereof at least one recess, wherein when the structure is formed from a plurality of the blocks, the at least one projection of one block engages with the at least one recess of another block.

18 Claims, 16 Drawing Sheets

BLOCK FOR USE IN CONSTRUCTING A RETAINING WALL WITH IMPROVED FEATURES

CROSS-REFERENCE TO RELATED APPLICATION

This application claims priority to and benefit of Canadian Patent Application No. 2,809,704, filed Mar. 15, 2013.

FIELD OF THE INVENTION

This invention relates to a block for retaining wall structures, preferably mortarless retaining wall structures and the construction thereof, wherein said wall may be vertical, set back, in whole or in part, with regard to the vertical, or set forward, in whole or in part, with regard to the vertical. Further it allows construction of decorative walls with substantially rounded or sharp corners using the block which may be geometrically adapted.

BACKGROUND OF THE INVENTION

Retaining walls are well known. These structures may be built including mortar, or as introduced more recently constructed from mortarless construction. The mortarless construction includes building blocks of predetermined design, which may be stacked course upon course as a wall, including a cap stone. Most blocks provided in the prior art are limited in the number of degrees of freedom that they provide the professional landscaper when constructing retaining walls. This invention obviates this limitation.

Many block constructions provide for only the ability of the contractor to build a set back retaining wall. Within a retaining wall system, it would be beneficial to be able to produce wall structures, which are set back and or set forward in some portions thereof and vertical in other portions thereof. Furthermore, there is a requirement of building walls with smooth curves and corners without use of specific curved blocks. This is heretofore unknown. Furthermore, there is a need to manufacture a standard block, which can be used both as a building stone and a corner stone thus increasing the versatility of these blocks.

It would be advantageous to be able to provide a standard block which may not only be set back, set forward, or a combination thereof when appropriate, but, which also may be stacked vertically when appropriate, such as when creating steps to traverse an incline to thereby not alter the step lengths since this may not always be desirable or esthetically pleasing.

It would also be advantageous to be able to provide a standard block which may be altered in geometrical shape and length to allow for a number of configurations in construction while maintaining an aesthetically pleasing end result.

Further, quite often, cribbing is provided to reinforce or tie back a retaining wall back into the incline around which the retaining wall is being built. Although this is desirable, it is not always cost effective. Therefore, there is a need for a retaining wall, which does not require cribbing structures being assembled. There exists, therefore a need for a simple, easy to use number of components which an installer may install course upon course to prepare a reasonable number of attractive options for the building owner without limiting the number of alternatives for which recommendations may be made by the landscaper.

Examples of prior retaining wall structures and the blocks used to manufacture retaining walls may be found in the following patents. U.S. Pat. No. 1,872,522 teaches manufacturing of artificial stone bricks with splitting grooves which upon splitting creates an irregular surface for "stone like" effect. U.S. Pat. No. 5,598,679 teaches manufacturing of concrete blocks, which can be separated into smaller construction blocks and used for construction of retaining walls.

U.S. Pat. No. 4,367,615 teaches a substantially rectangular shaped block of cementitious material which has a metal reinforcing member extending there through and embedded therein. The reinforcing member has a height substantially equal to the height of the block and extends past one end of the block, terminating in an elongated T-shaped tongue. Adjacent to the other end of the block, the reinforcing member terminates in an elongated groove, slightly larger than but complementary to the shape of the tongue. In use, adjacent blocks are loosely but securely locked together by the cooperating tongues and grooves of the reinforcing members of the adjoining building blocks U.S. Pat. No. 3,888,060 teaches interlocking blocks that are assembled in longitudinally staggered rows. The blocks are planar on their bottom side and include webs with interlocking protrusions on their upper side. The protrusions interact with the webs on adjacent rows of blocks to locate and hold the blocks in position.

U.S. Pat. No. 3,534,518 illustrates in FIG. 4 a corner block which may be utilized as seen in FIGS. 3 and 4. This block allows for interfitting with other blocks, including the projections illustrated.

U.S. Pat. No. 1,639,063 illustrates in FIG. 3 another corner block construction for a wall.

U.S. Pat. No. 2,668,435 illustrates in FIGS. 11 and 12 and the description related thereto a corner block construction.

U.S. Pat. Nos. 6,178,715 and 6,398,458 teach a standardized block construction having provided therewith the ability to form a retaining wall in whole or in part being substantially vertical, being substantially offset to the vertical, and being substantially set forward to the vertical.

The current invention provides further improvements to the prior art blocks.

It is therefore, a primary object of the invention to provide a standardized block construction which includes the ability to expose a smooth and/or a rough face at both faces of the block.

It is yet a further object of the invention to provide a standardized block for retaining wall systems, which include the necessary features to allow for in whole or in part setting course upon course in substantially vertical alignment, in set back alignment to the vertical, in set forward alignment to the vertical, positioning of the block at an angle or any combination thereof in a retaining wall system.

It is a further object of the invention to provide a standardized block construction which, in combination with the features of the block improves both lateral and longitudinal stability of the block when it is placed course upon a course to form a structure, such as a retaining wall.

It is yet a further object of the invention to provide a standardized block which may serve as a corner block, preferably which may be utilized as a left-hand or a right-hand corner block.

It is yet a further object of the invention to provide a standardized block which may be positioned in parallel, perpendicular or angled positioned relatively to the below positioned block.

It is yet a further object of the invention to provide a block which may be separated at one of the corners at substantially a 45°.

It is yet a further object of the invention to provide a retaining wall system, including the standardized block of the present invention, which provides when stacked course upon course with one another, an esthetically pleasing retaining wall system.

Further and other objects of the invention will become apparent to those skilled in the art when considering the following summary of the invention, and the more detailed description of the preferred embodiments illustrated herein.

SUMMARY OF THE INVENTION

According to one aspect of the invention, there is provided a block for construction of a structure, preferably a substantially mortar less structure, most preferably a retaining wall. Said block comprises a top, bottom, two ends and two sides, at least one score line, preferably a plurality of score lines, allowing for changing the geometry of the block, preferably allowing for changing the length of the block, most preferably allowing for removing of at least one of its corners or at least of its ends.

Furthermore, the block comprises at least one directional projection, preferably a series of directional projections, which facilitates in the placement of the block in various orientations to construct structures, preferably mortar less structures, most preferably mortar less retaining walls, of preferably complex geometry. Said directional projections may be of the same or different geometrical shapes and combinations thereof, which facilitates in the placement of the block in various orientations as discussed herein.

Furthermore, the block comprises at least one interlock projection, preferably wherein said interlock projection is selected from at least one rib, at least one recess or combinations thereof, wherein said at least one recess for receiving the at least one directional projection, preferably for receiving the at least one rib and/or the at least one interlock projection. Preferably said at least one recess matingly receives at least one directional projection, preferably the at least one rib and/or the at least one interlock projection.

According to one aspect of the invention, there is provided a block, for forming a structure, preferably a retaining wall, said block comprising a top, a bottom, a front wall (or a front face), a back wall (or a back face) and two side walls. The block comprising, preferably at the top thereof, at least one projection, preferably at least one interlock projection, and at least one directional projection. Preferably said block comprises a plurality of interlock projections, and a plurality of directional projections. Furthermore, said block comprises preferably at the bottom thereof at least one recess for receiving the at least one directional projection and/or the at least one interlock projection. Preferably said block comprises at the bottom thereof, a plurality of recesses. When a structure comprising at least two blocks is to be formed, preferably a wall is to be formed, preferably from a plurality of said blocks; for example a first block and a second block the at least one projection of a first block engages with the at least one recess of a second block to provide resistance to lateral shear in relation to the block when stacked course upon course. In one embodiment, engagement of said at least one directional projection of said first block with said at least one recess of said second block allows the positioning of a plurality of stacked blocks in parallel, perpendicular and also at various angles to each other.

According to another aspect of the invention, the block further comprises two zones, preferably on said top thereof. The first zone, preferably a lateral zone comprises at least one longitudinal projection, preferably a plurality of longitudinal projections, permitting the placement of an above positioned block in a generally laterally parallel orientation of one block to another block. The second zone, preferably a corner zone, comprises at least one directional projection, preferably a plurality of directional projections, permitting placement of an above positioned block in a plurality of positions selected from substantially laterally parallel, substantially laterally perpendicular, and at lateral angles of 45° and 135° to the said block, thus, in one instance creating a corner, in a structure, such as a retaining wall, wherein said corner may be selected from a plurality of angles, preferably 45°, 90° and 135°.

In yet another embodiment, said two zones are each corner zones.

According to yet another aspect of the invention the corner zone comprises a directional projection, preferably at least two directional projections, most preferably at least three directional projections, even most preferably four directional projections, preferably each of said directional projections is a generally triangular directional projection, wherein upon placement of an above positioned block (in parallel, vertical, set back, set forward, perpendicular or angular and combinations thereof), the at least one recess of the above positioned block interacts, preferably engages, most preferably matingly engages with said directional projection of the below positioned block in at least one of the following manner: in a parallel placement, the recess engages at least one directional projection; in an angular placement it engages at least one of the directional projections, preferably at least two of the directional projections while in the perpendicular placement it engages at least one of the directional projections, preferably at least three of the directional projections, wherein in one instance, improving the longitudinal strength of the retaining wall. Most preferably said recess engages with all four directional projections. In yet another embodiment, said directional projection is selected from a substantially triangular projection, a substantially hexagonal projection and combinations thereof.

According to a preferred embodiment of the invention, the corner zone further comprises at least one removable segment, preferably a plurality of removable segments, most preferably three removable segments, defined by at least one score line, preferably a plurality of removable segments, most preferably three score lines. Preferably each score line defines each removable segment of said block. Upon the removal of said removable segment through engagement of at least one or more score lines, the block is either reduced in length, at least one corner is removed and/or rounded (or truncated) or both the corners are removed and/or rounded (or truncated) and the overall length of the block remains the same or if the length segment is also removed, the overall length of the block is also reduced with one or both corners removed. This allows for a plurality of geometrical configurations when forming a structure.

According to yet another aspect of the invention, there is provided a standard block for use in structures and construction thereof, preferably for use in the construction of a retaining wall, said block having a top and a bottom and four walls, the bottom comprises a plurality of grooves or recesses, preferably a plurality of substantially parallel grooves or recesses, and the top comprising a lateral zone and a corner zone. The lateral zone comprises a plurality of parallel projections to receive corresponding parallel grooves or recesses of a second block in parallel positioning. Wherein the corner zone comprises at least one directional projections, preferably a plurality of directional projections, most preferably four directional projections to receive said at least one of said grooves or recesses, preferably to receive said parallel grooves or recesses of an above positioned block while positioned in parallel, perpendicular, 45° or 135° to the standard block.

Preferably, the block further comprises at least one score line for longitudinal separating, preferably a plurality of score lines, most preferably three score lines for longitudinal separating of said block into at least two smaller blocks, preferably into a plurality of smaller blocks. Said at least one score line for longitudinal separating is preferably on at least one of said top, bottom or at least one of said walls and combinations thereof. Preferably proximate one of said wall of said block.

According to yet another aspect of the invention there is provided a structure formed from at least one of the blocks of the present invention, preferably a retaining wall formed from a plurality of the blocks described above, wherein a plurality of bottom grooves and top projections on each of said blocks allow the construction of a structure, having setback and/or set forward wall and/or set vertical configurations and combinations thereof, wherein a first course extends from a second inferior course in a substantially vertical relation, whereat a third course extends from said second course in a substantially set-back relation for the vertical courses of the wall being constructed and wherein a fourth course extends substantially as a set forward course in relation to the vertical for the wall being formed. As is clear, the combination of set forward, set back and/or set vertical is variable as is the number of courses.

According to yet another aspect of the invention, there is provided a dual-block module comprising two blocks described above having adjacent faces joined together proximate a first score line, at least one of said blocks having disposed proximate opposite faces which are not joined a removable section separated from the block by a second score line thereby permitting presentation of either a smooth face for the block when the removable section is retained, or a rough split face or smooth sawn face for the block when the removable section is removed.

According to a further aspect of the invention there is provided a form for manufacturing a single block described above or a double block described above.

According to yet another aspect of the invention, there is provided a block for forming a structure, said block comprising a top, a bottom, a front wall, a back wall and two side walls, said block having disposed proximate the top at least one projection, said block having disposed proximate the bottom thereof at least one recess, wherein when the structure is formed from a plurality of said blocks, said at least one projection of one block engages with said at least one recess of another block.

Preferably the top of the block further comprises two zones, a first zone being a lateral zone, and a second zone being a corner zone; said lateral zone further comprises at least one longitudinal projection permitting an above positioned block to be placed generally laterally parallel to said block; wherein the corner zone comprises at least one directional projection permitting placement of an above positioned block in at least one direction other than substantially laterally parallel. In another embodiment, said two zones are each a corner zone.

Preferably the corner zone further comprises a plurality of directional projections, wherein during placement of an above positioned block, at least one recess of the above positioned block engages with at least one of said directional projections in at least one of the following: in a substantially parallel placement at least one recess engages at least one directional projection; in an substantially angular placement at least one recess engages at least one directional projection, preferably at least two directional projections; and in a substantially perpendicular placement at least one recess engages at least one directional projections, preferably at least three directional projections.

In another embodiment, the corner zone further comprises at least one removable segment defined by at least one score line, wherein upon the removal of said removable segment by engagement of said at least one score line the block:

i) is reduced in length; and/or ii) is reduced by at least one corner thereof; and/or iii) is reduced at both corners thereof;

and/or combinations thereof.

According to yet another aspect of the invention, there is provided a building block having a top and a bottom, and four side walls, the bottom comprising a plurality of substantially parallel recesses, the top comprising at least one zone, preferably two zones, preferably a lateral zone and a corner zone, the lateral zone further comprising a plurality of substantially parallel projections for matingly reception of said parallel recesses, said corner zone comprising a plurality of directional projections to receive at least one of the substantially parallel recesses of an above positioned block, while positioning it in parallel, in perpendicular, at substantially 45° or at substantially 135° to said block, further the corner zone comprises at least one removable segment defined by at least one score line. In one instance, said two zones are corner zones.

Preferably said block further comprises at least one recess defining at least one removable segment for separating said block into at least two blocks. Preferably said recess is proximate at least one of the walls, top or bottom of said block, most preferably on at least one of the walls.

Preferably said block comprises a plurality of removable segments, preferably defined by respective score lines, most preferably at least three removable segments defined by three score lines respectively, preferably at least one of the walls comprise three score lines.

According to yet another aspect of the invention, there is provided a mortar less retaining wall formed from a plurality of blocks of the present invention.

According to yet another aspect of the invention, there is provided a dual-block module comprising two blocks of any one of the blocks of the present invention having adjacent faces joined together proximate at least one score line.

According to yet another aspect of the invention, there is provided a construction block, said block comprises a top, a bottom, a front wall, wherein said front wall is either substantially smooth or substantially rough, or a combination thereof, a substantially smooth back wall, a left wall and a right wall, wherein:

the top comprises:

a) three longitudinal projections extending from said left wall of the toward said right end, b) proximate said right wall of the block, said top has three score lines: a first score line running substantially parallel to said right wall and two score lines substantially 45° to said first score line, the first score line allows removal of the smooth right wall creating a shorter block, and said two other score lines substantially 45° to said first score line allow removal of one or two of the corners proximate said right wall of the block;

c) said top further comprises directional projections positioned between the score lines and the longitudinal projections of the block, said directional projections allow positioning of an above positioned block, in a substantially parallel, substantially perpendicular, substantially 45° or substantially 135° angular relation to a bottom positioned block, the bottom of the block comprises:

a plurality of longitudinal recesses adapted to receive corresponding said longitudinal projections on the top of the block, the longitudinal recesses extending from the left wall of the block proximate the right wall of the block;

the substantially smooth back wall of said block comprises: a plurality of substantially vertical score lines along the wall, for optional separation of the block into a plurality of shorter blocks.

A further aspect of the present invention allows manufacturing several smaller blocks with different geometry, from the same block. One way to modify the geometry of the block focuses on removal of at least one segment defined by at least one score line zone.

Further aspects of the invention will be apparent from the provided drawings, descriptions and claims.

DETAILED DESCRIPTION

Figure 1:
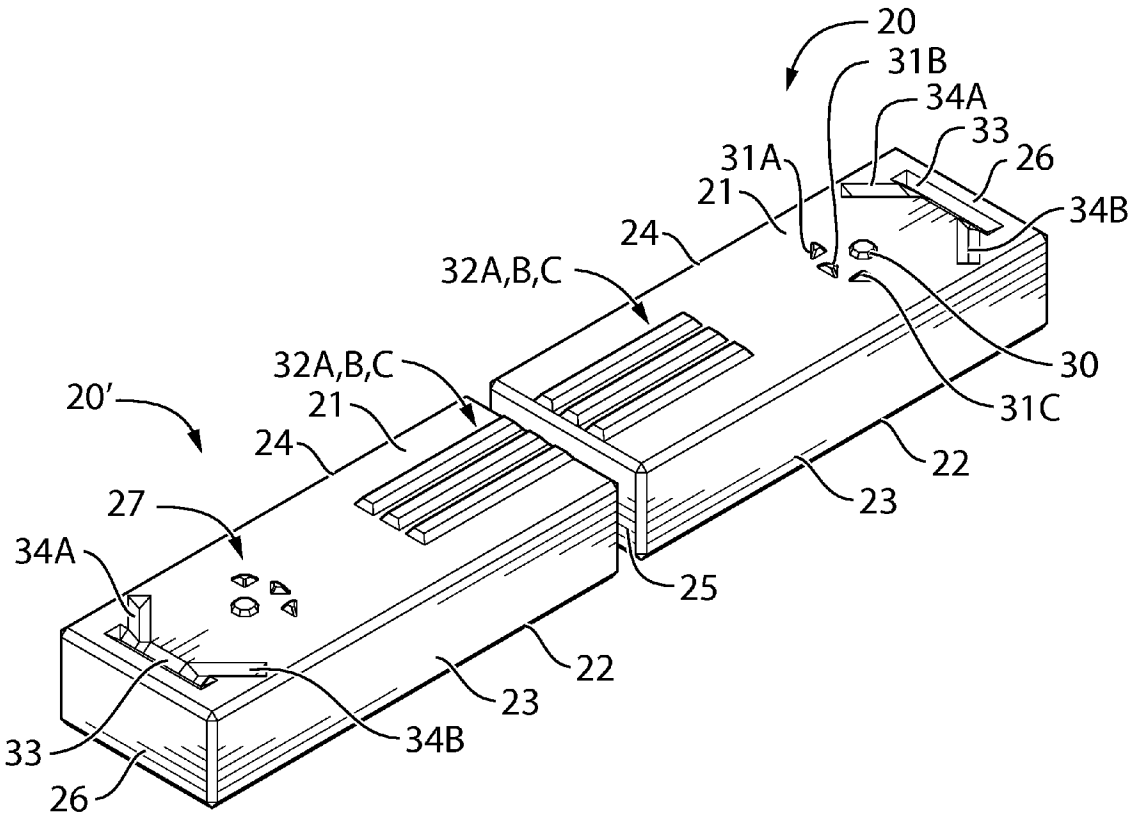
FIG. 1 is a perspective elevated front view of the dual block module when separated into two blocks, according to one embodiment of the present invention.

Referring now to FIGS. 1 through 5, there is illustrated a block 20. The block 20 includes a top 21, a bottom 22, a rough face 23, a smooth face 24, and two sides 25 and 26. The block 20 may therefore be formed in a dual block module formed substantially as seen in FIGS. 4A, 4B, 5 and 35 which are joined along score line 39 and which are separated thereat if desired to form two distinct blocks 20 and 20', preferably, each block being similar in design and more preferably each block being a left and a right-hand block.

Figure 2:
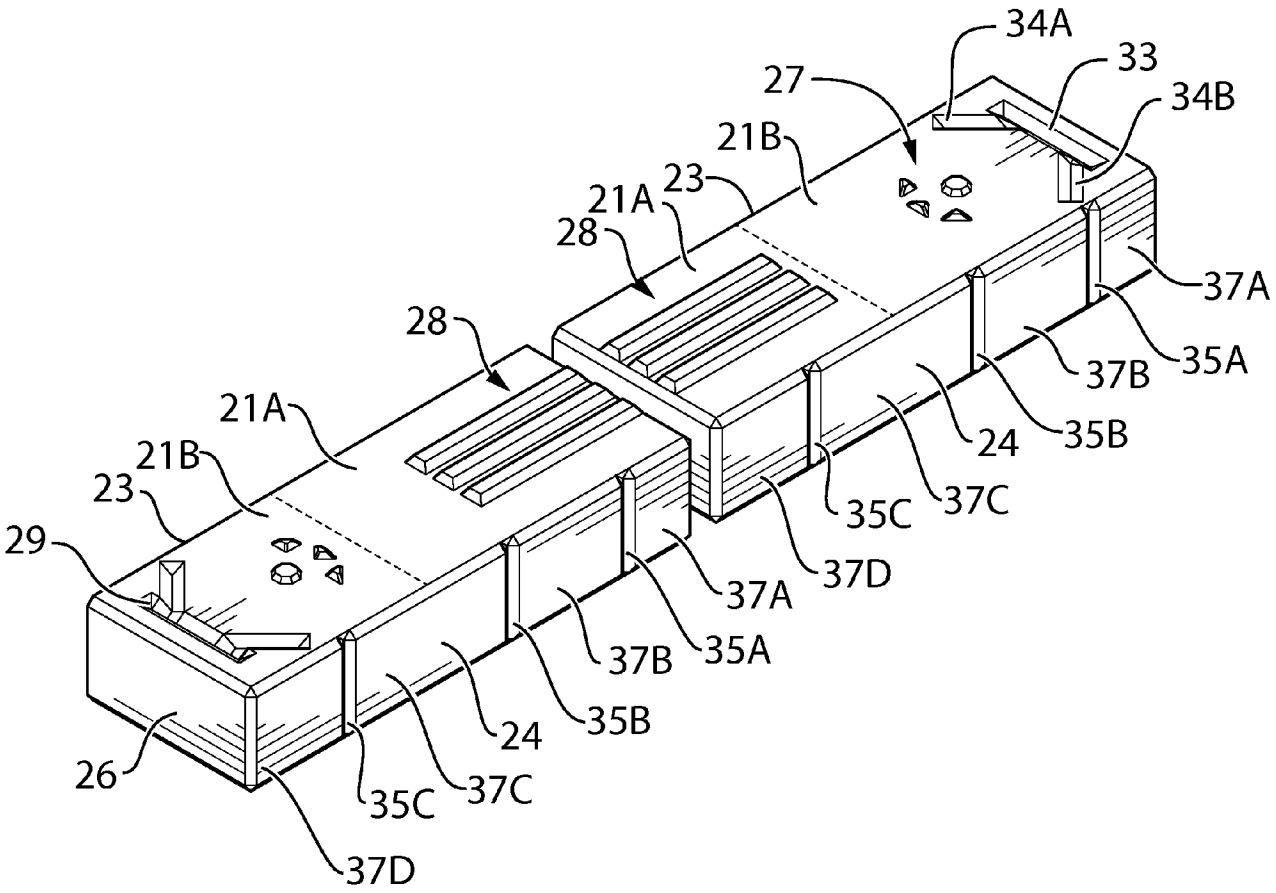
FIG. 2 is perspective elevated rear view of the dual block module when separated into two blocks of FIG. 1, according to one embodiment of the present invention.

The top of the block 20 has two zones/areas as illustrated in FIG. 2, the lateral area 21*a* and a corner area 21*b*. The corner area 21*b* has a directional projection zone 27 and a removable segment zone 29. These areas allow a use of the same block as a regular construction block and also as a corner block. The lateral area 21*a* has a rib zone 28 having at least one rib 32, preferably three ribs 32*a*, 32*b*, and 32*c*. However the number of these ribs may vary according to design requirements.

As discussed above, the two zones may each be corner areas.

The removable segment zone 29 has at least one, but preferably three score lines 33, 34*a* and 34*b*. By removing segment 29 by engaging score line 33, the length of the block may be shortened and face 26*a* is exposed (See FIG. 9). In this instance, a rough face is exposed. However, if engaging score line 33 by other means known in the art, such as with a saw, a smooth face will be exposed. In engaging score lines 34*a* or 34*b*, at least one the corner of the block 20 may be removed to provide a substantially truncated or triangular end like structure (See FIGS. 10-13).

Score lines may be added or removed to the block according to design requirements. Removal of segments at zone 29 provides the block with a rough surface 26*a* and/or 26*b*, which may be rough or smooth, whichever is desirable by design when constructing.

Figure 6:
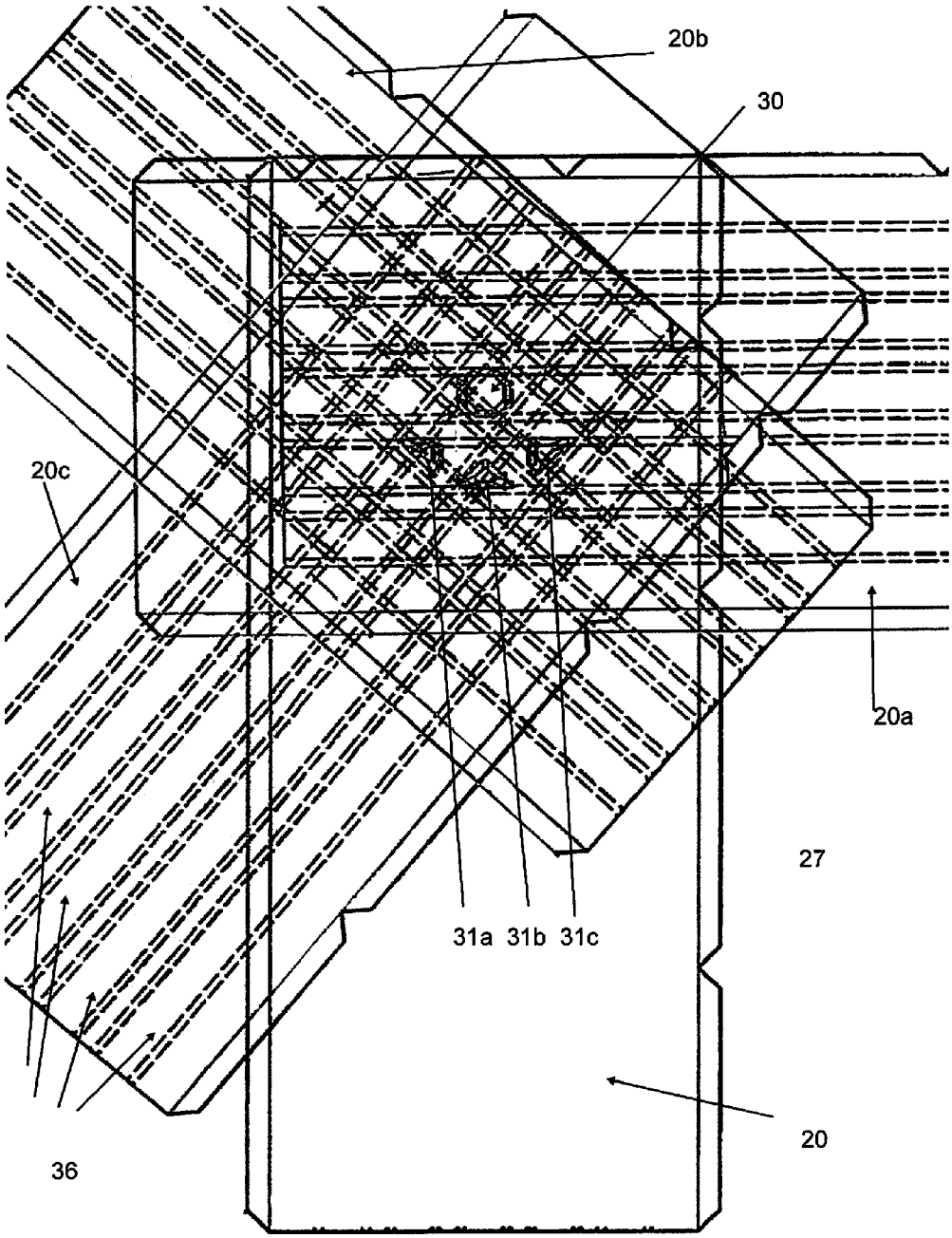
FIG. 6 is a schematic top view of several angular positions of a top block relative to a bottom block, according to one embodiment of the present invention.

Directional projection zone 27 includes several projections 30, 31*a*, 31*b* and 31*c*, used to direct the orientation of an above positioned block relative to the lower positioned block (See FIG. 6). The projections may also be used to engage the above positioned block relative to the lower positioned block, by the matingly engagement of the projections with the recesses (See FIGS. 4A and 6).

FIG. 2 illustrates the face 24 of the block 20. The face 24 may be manufactured substantially smooth or substantially rough. In the preferred embodiment, the face 24 is substantially smooth with a plurality of substantially vertical score lines 35 dividing said face 24 into several segments 37. In this particular embodiment, the face 24 is divided into four segments 37*a*, 37*b*, 37*c*, and 37*d* by three score lines 35*a*, 35*b* and 35*c*. However the number of score lines and thus segments may vary according to design requirements. Score lines 35*a*-35*c* allow further manipulation of the size and length of the block depending on installation and construction requirements.

The block 20 may be modified from either lateral area 21*a* or from the corner area 21*b* thus providing the constructor with greater flexibility and variety of block geometry for construction. Segments 37*a*, 37*b*, 37*c* and 37*d* may be of same or different size in order to allow interlocking of the blocks during construction.

Preferably, segments 37 are positioned in reverse order on the two blocks 20 and 20'. As best illustrated in FIG. 4A, the segment 37*a* of the block 20 is positioned proximate the side 26, wherein the segment 37*a* of the block 20' is positioned proximate the side 25, thus allowing randomization of the blocks upon separation by the score lines 35*a*, 35*b* and 35*c* of each block 20 and 20'.

Figure 3:
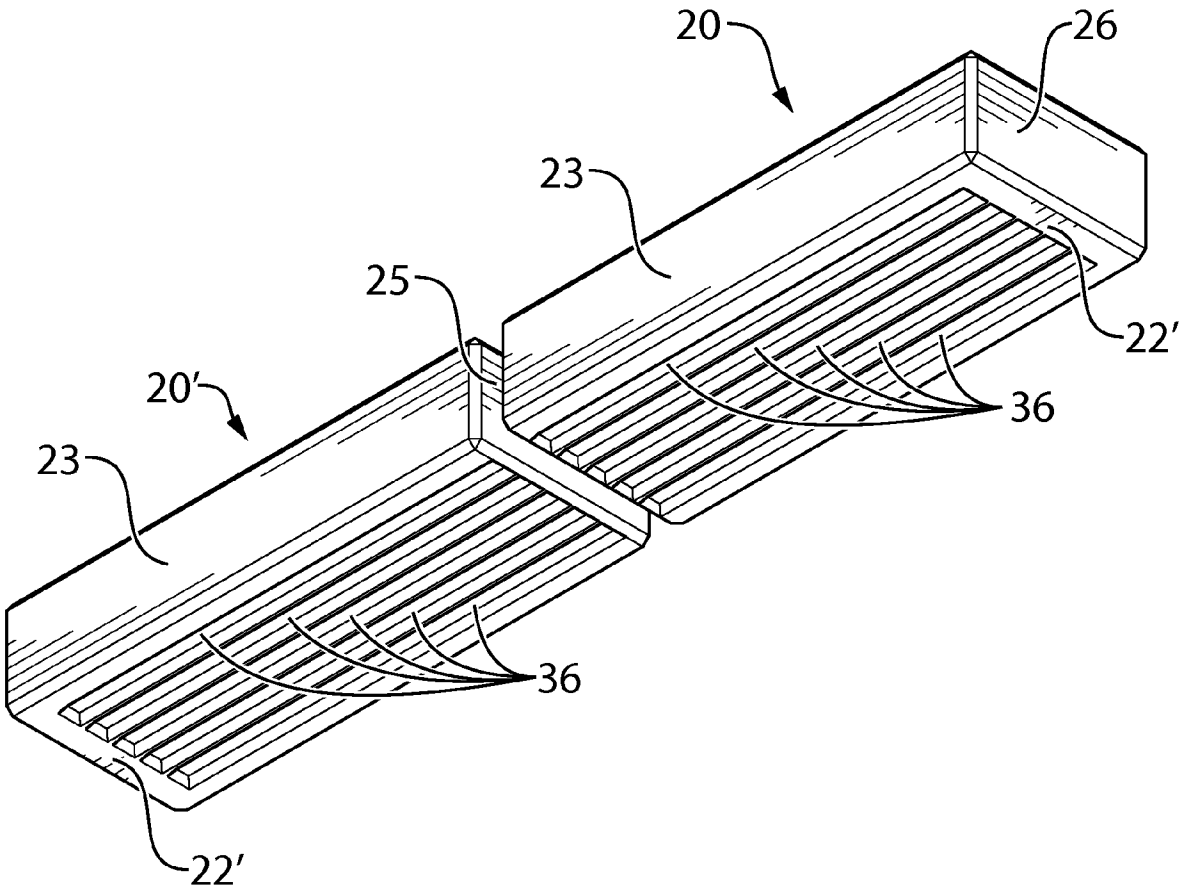
FIG. 3 is a perspective bottom view of the dual block module when separated into two blocks of FIG. 1, according to one embodiment of the present invention.
Figure 5:
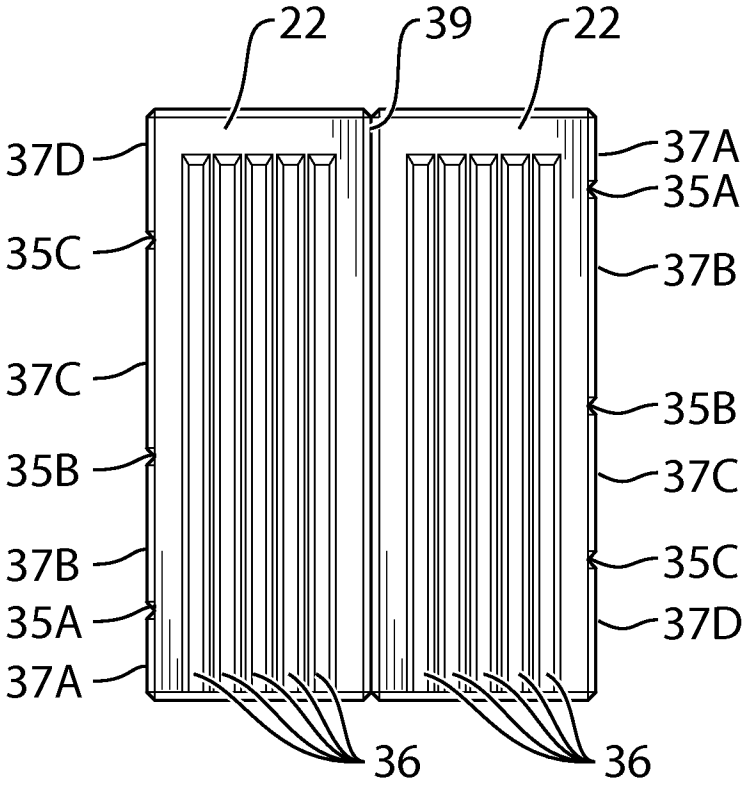
FIG. 5 is a bottom view of the dual block module, according to one embodiment of the present invention.

FIG. 3 illustrates a bottom view of each block 20 and 20'. Bottom 22 of each block 20 and 20' has multiple recesses 36. These recesses are designed to receive ribs 32 and/or directional projections 30, 31*a*, 31*b* and 31*c*. Preferably there should be at least one recess 36, more preferably three recesses and most preferably five recesses. However other number of recesses may also be utilized. In one of the embodiments, preferably the recesses do not run through the whole length of the block. As best illustrated in FIGS. 3 and 5, there is a section of the bottom 22' not intersected by the recesses 36. Preferably, this section is located proximate the removable segment 29 portion of block 20, 20' to add structural stability to the wall when the block is not used at a corner.

Figure 4C:
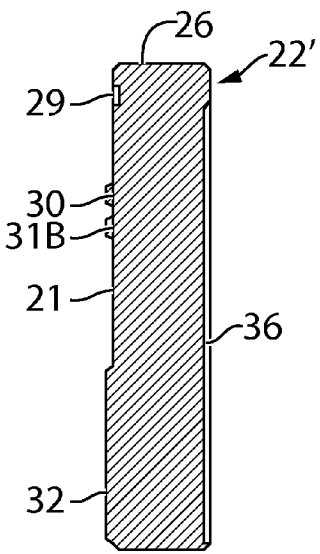
FIG. 4C is a cut view through line B of the dual block module of FIG. 4A, according to one embodiment of the present invention.
Figure 4B:
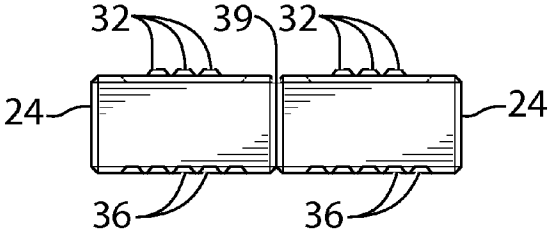
FIG. 4B is a front view of the dual block module, according to one embodiment of the present invention.
Figure 4A:
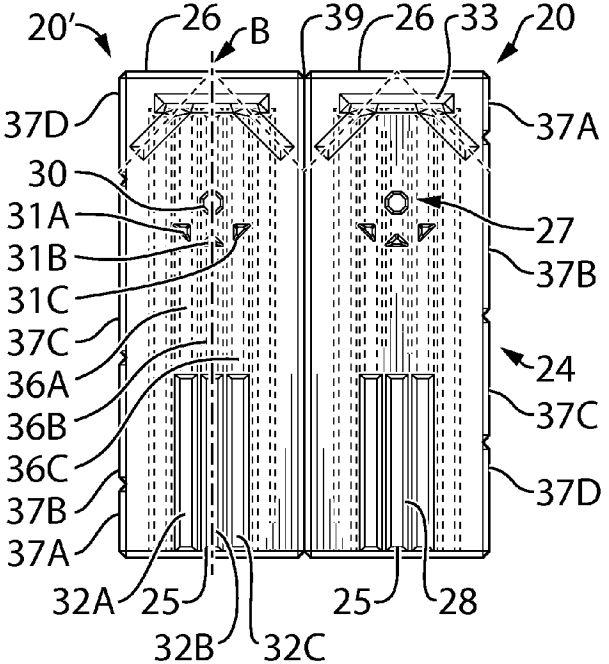
FIG. 4A is a top view of the dual block module according to one embodiment of the present invention.
Figure 22:
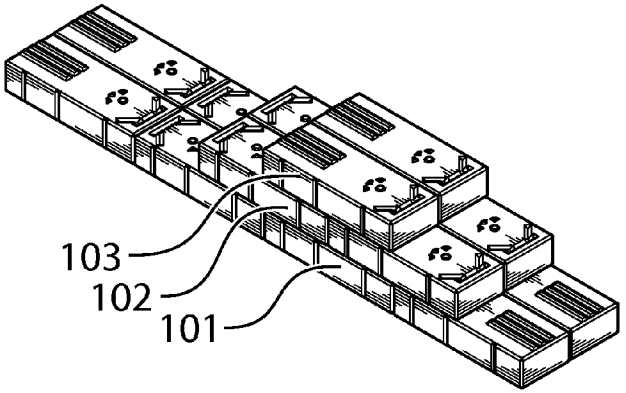

FIGS. 4A, B, C illustrate three views of the joined blocks 20 and 20' as a dual block module. These blocks may be manufactured as joined blocks (dual block module) and then separated via score line 39, thus creating a rough face 23 on each block as illustrated in FIG. 3. If design requires, the joined blocks 20 and 20' may also be used for construction of structures, preferably walls or wall bases as illustrated in FIG. 22. FIG. 4C illustrates the cut through the block 20 through its center line B. From this illustration it is easy to see that the directional projections 30 and 31 as well as ribs 32 are positioned on top 21. FIG. 4B further illustrates extensions of ribs 32 upwardly from top 21 of block 20 and 20' and position of the recesses 36 along bottom 22 of block 20 and 20'.

FIG. 4A schematically illustrates the position of one set of joined blocks on top of another set of joined blocks. This illustration shows recesses 36*a*, 36*b* and 36*c* engaging ribs 32*a*, 32*b* and 32*c*, respectively, and also engaging directional projections 31*a*, 31*b* with recesses 36*a* and 36*c*, respectively. In this specific embodiment recess 36*b* engages rib 32*b* and directional projections 30 and 31*b* while recesses 36*a* and 36*c* engage ribs 32*a* and 32*c* and directional projections 31*a* and 31*c* respectively. Other positionings of a first block in relation to a second block are presented in FIG. 7

If desired, the block of FIG. 4A may present two smooth faces at the side 26. Alternatively, if the installer removes the removable segment 29 through engagement of score line 33, if split, a rough face 26*a* (FIG. 9) similar to the face 23 in FIG. 3, will be exposed. If separated by cutting or sawing or other methods known in the art, a smooth face will be exposed. This option depends on the desired aesthetic look. It will be noted that blocks 20 and 20' in one embodiment, are substantially identical except for the location of the recesses 35 along each face 24 of each block 20 and 20'.

Figure 4D:
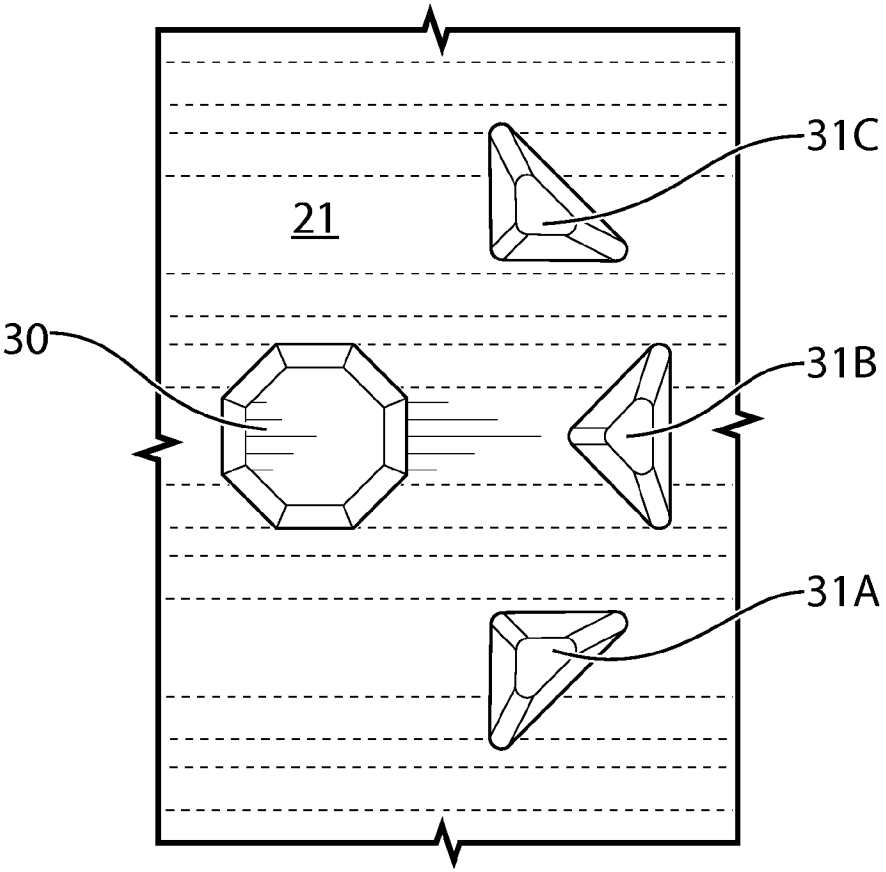
FIG. 4D is a close up of the area 27 of FIG. 4A, according to one embodiment of the present invention.

FIG. 4D illustrates a close-up of the directional projections zone 27 of corner area 21*b* of block 20. In this specific embodiment, directional projections zone 27 includes four directional projections: three triangular projections 31*a*, 31*b* and 31*c* and one octagonal projection 30. These projections allow positioning and engagement of an above located block in several different positions relatively to the lower block. Since the dimension of the bottom recesses 36 allows engagement of one or more directional projections, there are several possible engagement variants. First is a parallel positioning of the blocks, wherein at least one recess 36 engages projections 30, 31*a*, 31*b* and 31*c*. Second is a perpendicular position wherein at least one recess 36 engages all three projections 31*a*, 31*b* and 31*c*. Alternatively at least one recess 36 may engage projection 30. Third is a 45° position wherein at least one recess 36 engages projections 30 and 31*a* and/or 31*b* and 31*c*. Fourth is a 135° position wherein at least one recess 36 engages projections 30 and 31*c* or 31*b* and 31*a*. In the same way the above positioned block may be positioned at 180°, 225°, 270° and 315° to the bottom positioned block providing a total of 8 different directions at 0°/360°, 45°, 90°, 135°, 180°, 225°, 270° and 315° angles. Several of these positions are illustrated in FIG. 6.

In addition to these angular relations, the top and the bottom blocks may be positioned in a setback, set front and straight relationship, as best seen in FIGS. 7, 18-21. Therefore, a pair of blocks 20 with five recesses 36, three ribs 32 and four directional projections 30, 31*a*, 31*b* and 31*c* may theoretically be positioned in 24 different ways relative to each other. Several of these positions are depicted in FIGS. 14-33 discussed below.

FIG. 5 depicts the bottom of the dual block module of FIG. 4A with a clear view of bottom recesses 36.

FIG. 6 depicts some of the various angles in which blocks may be positioned on top of the directional projections 30, 31*a*, 31*b* and 31*c*. The bottom positioned block 20 is illustrated only with the directional projections 30, 31*a*, 31*b* and 31*c*. The above positioned block 20*a* is positioned in 90° to the bottom positioned block 20. It is apparent that one of the recesses 36 engages the hexagon projection 30 and another recess engages the three triangular projections 31*a*, 31*b* and 31*c*. Alternatively the block 20*a* may be positioned in set back or set forward position creating three variants of positioning. Further instead of extending to the right hand side of the block 20 as illustrated in FIG. 6, the block 20*a* may be positioned while extending to the left hand side of the block 20, thus allowing another 3 ways to position it at a 270° to the block 20.

The block 20*b* is positioned at 45° to the block 20, however using the same clock convention as above when 0° is at the top, block 20*b* is positioned at 315° to the block 20. It is apparent that one of the recesses 36 of the block 20*b* engages the hexagon projection 30 and one of the triangular projections 31*c* while another recess engages two triangular projections 31*a* and 31*b*. This block may also extend in the opposite direction at 135° and be positioned in set forth or set back positions, for a total of 6 variations.

The block 20*c* is positioned at 225° to the block 20. It is apparent that one of the recesses 36 of the block 20*b* engages the hexagon projection 30 one of the triangular projection 31*a* while another recess engages two triangular projections 31*b* and 31*c*. This block may also extend in the opposite direction at 45° and be positioned in set forth or set back positions, for a total of 6 variations.

Figure 7:
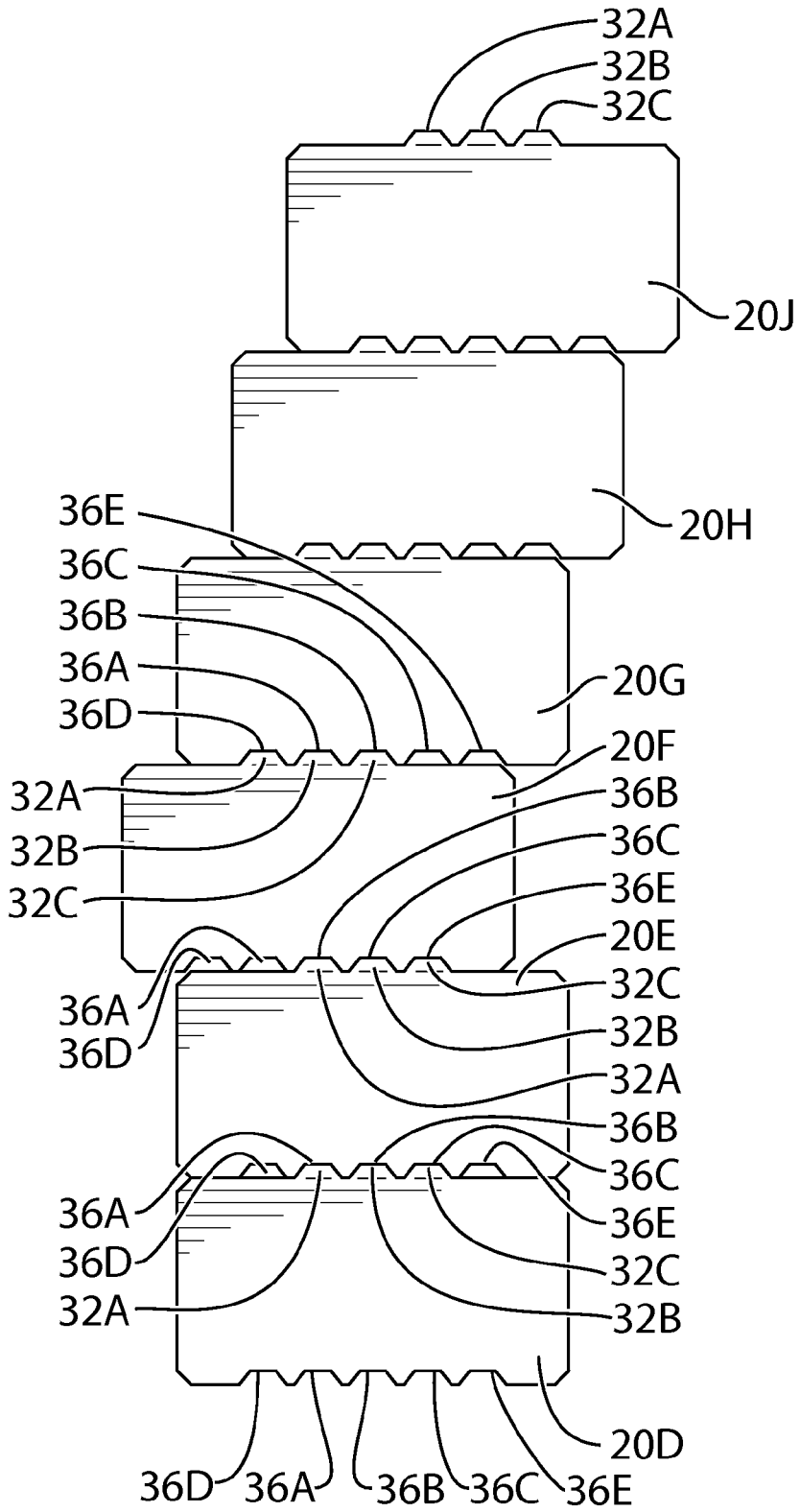
FIG. 7 is schematic side view of several blocks in set forward and setback positions, according to one embodiment of the present invention.

FIG. 7 depicts positioning of the blocks in set forward and set back positions. As described above, Ribs 32 and recesses 36 allow positioning of the blocks 20 and 20' in vertical, set forward and set back positions. In a first embodiment the block 20*e* is positioned vertically above block 20*d*. In this case recesses 36*a*, 36*b* and 36*c* engage ribs 32*a*, 32*b* and 32*c*. In a second embodiment, the above positioned block 20*f* is positioned to the left of the center line of block 20*e* (this can be considered as a set forward position). In this case the recess 36*b* engages rib 32*a*, recess 36*c* engages rib 32*b* and recess 36*e* engages rib 32*c*. While in yet another embodiment the above positioned block 20*g* is positioned to the right of the center line of block 20*f* this can be considered as a setback position. In this case the recess 36*d* engages rib 32*a*, recess 36*a* engages rib 32*b* and recess 36*b* engages rib 32*c*. According to the design requirements, several block layers may be positioned in setback, set forward and vertical relations. For example blocks 20*j*, 20*h* and 20*g* are all positioned in a setback relationship.

Figure 8:
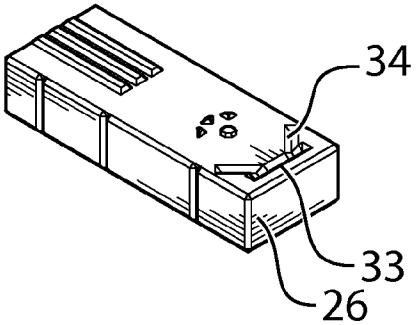

FIG. 8 depicts a single block 20 without engaging any of score lines 33, 34*a* and 34*b*. This maintains the smooth surface of end 26 as well as the original length of the block 20.

Figure 9:
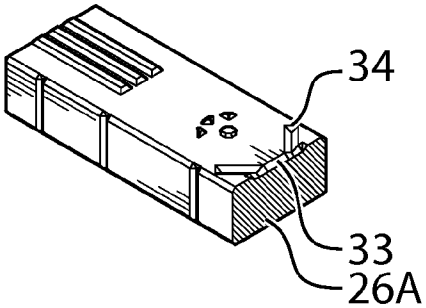

FIG. 9 depicts block 20 when score line 33 has been engaged, resulting in a end 26*a*, which, depending on the separating method used, will result in a rough or smooth end, and a shorter block 20.

Figure 10:
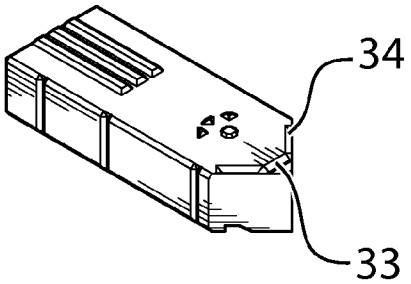
FIG. 8-13 illustrate schematic elevation views of the block in various geometric forms and length, according to various embodiments of the present invention.

FIG. 10 depicts block 20 when score lines 34*a* and 34*b* have been engaged, resulting in a block 20 having a triangular end.

Figure 11:
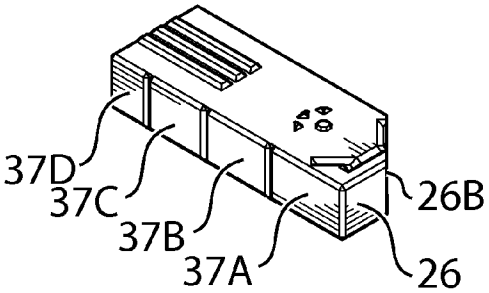

FIG. 11 depicts block 20 when one of score lines 34*a* or 34*b* has been engaged and score line 33 has not been engaged.

Figure 12:
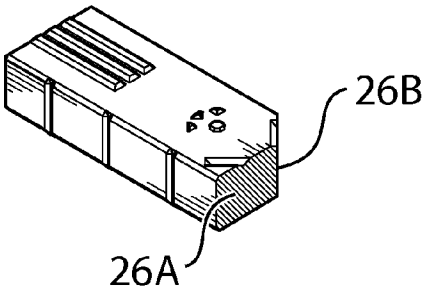

FIG. 12 depicts block 20 when one of score lines 34*a* or 34*b* has been engaged and score line 33 has also been engaged resulting in a shorter block with one truncated corner (or a frustrum).

Figure 13:
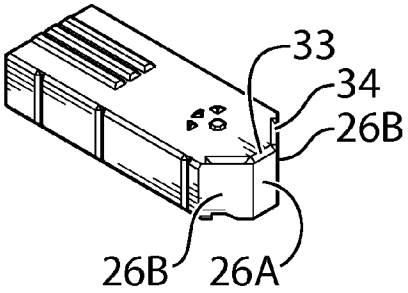

FIG. 13 depicts block 20 when score lines 33, 34*a* and 34*b* have been engaged resulting in a trapezoidal like block end.

In one of the alternative embodiments, face 23, face 24, and sides 25 and 26 of the block 20 may be made smooth. While in other embodiments some may be rough while some may further comprise at least one recess. All these variations are available according to the design requirements during the block manufacturing process.

Figure 35:
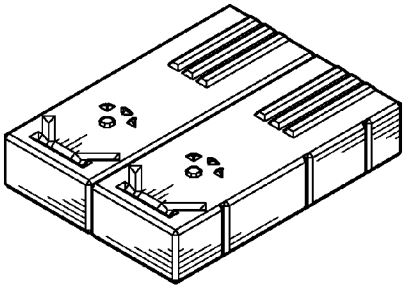
FIG. 35 illustrates an elevated view of the dual block module.

The block of the present invention may be manufactured as a dual block module (as best seen in FIGS. 4A, 5 and 35) or as a single block (as best seen in FIG. 8). When the block is manufactured as a dual block module, all the faces and sides of the block are smooth. The inside faces may be exposed by engaging score lines 39, 30 or 34. In one instance, when the block is manufactured as a single block, all the faces and sides are smooth unless score line 30 is engaged to expose rough side 26*a*. The rough faces exposed following the engagement of the score lines resemble the "natural" roughness of a stone. Separation at the score line may also be done by methods known in the art to expose a rough or smooth surface, as desired.

According to yet another embodiment of the invention the mold for a single block may comprise a rough wall, thus there is an option to generate single blocks with a single rough face without engaging a score line.

FIGS. 14-17 depict several ways of positioning the blocks of the present invention, wherein the blocks are in various geometrical shapes as per FIGS. 8-12.

Figure 14:
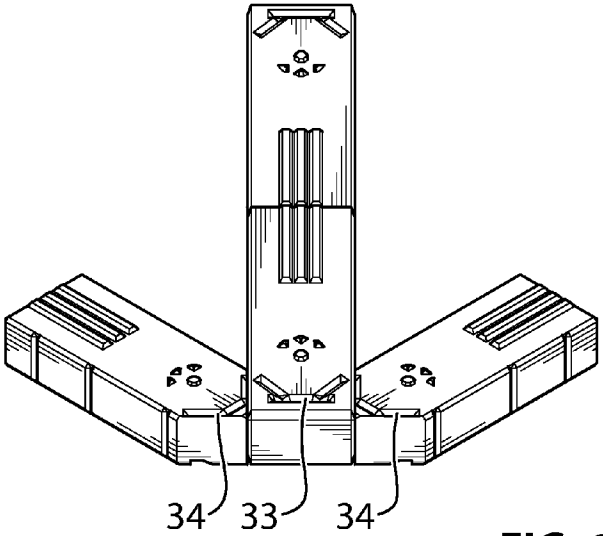

FIG. 14 depicts the combination of the block of FIG. 8 with the block of FIG. 10 on each side thereof. In particular a block with a face formed by the engagement of score line 34*a* is placed against face 23, and a block with a face formed by the engagement of score line 34*b* is placed against face 24. Side 25 of a fourth block is place against side 25 of the block of FIG. 8.

Figure 15:
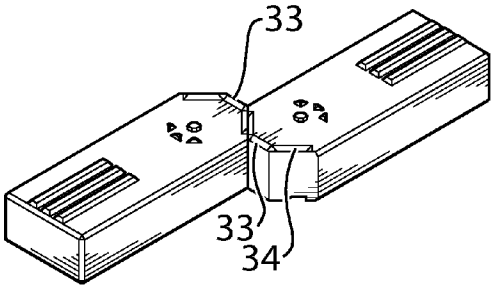
FIG. 14-33 illustrate schematic elevation views of various arrangements using the blocks of the present invention.

FIG. 15 depicts two blocks of FIG. 13 joined end to end at their respective faces formed by the engagement of score line 34*a* or 34*b*.

Figure 16:
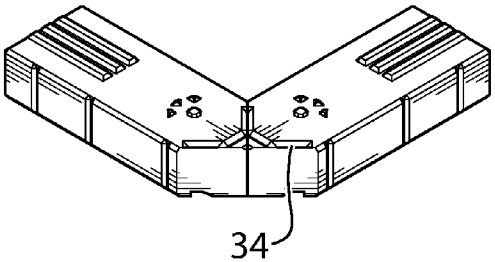

FIG. 16 depicts two blocks of FIG. 10 joined side by side at their respective faces formed by the engagement of score line 34*a* or 34*b*.

Figure 17:
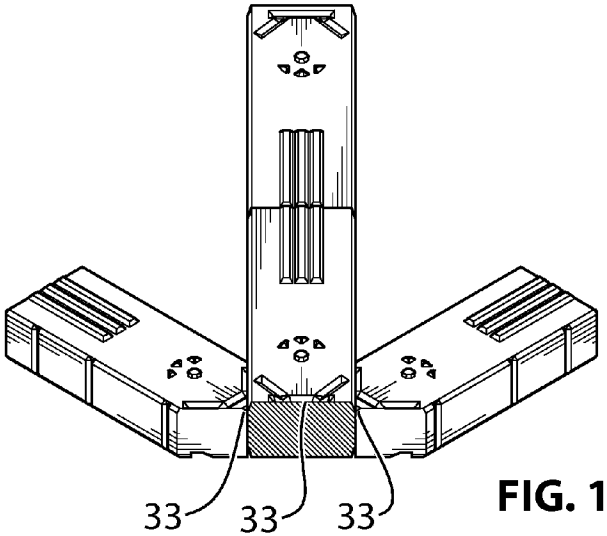

FIG. 17 is similar to the combination of FIG. 14, but in this instance, score line 33 has been engaged. Thus the blocks in FIG. 17 are shorter than the blocks in FIG. 14, and the exposed faces resulting from engaging the score lines may be rough, smooth or combinations thereof, depending on the separation technique.

Figure 19:
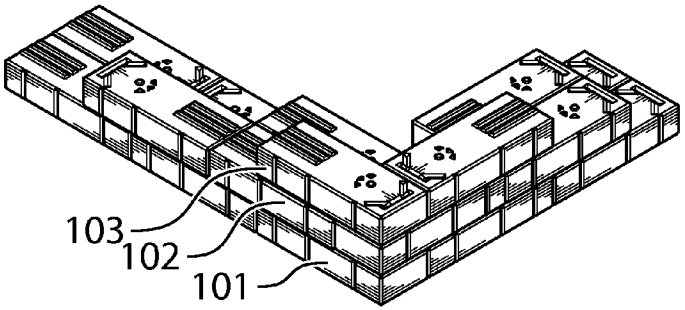
Figure 18:
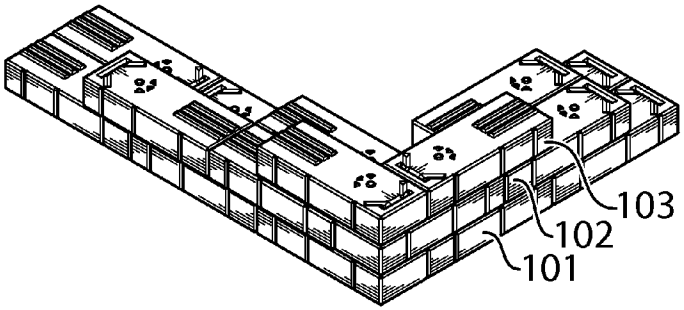
Figure 21:
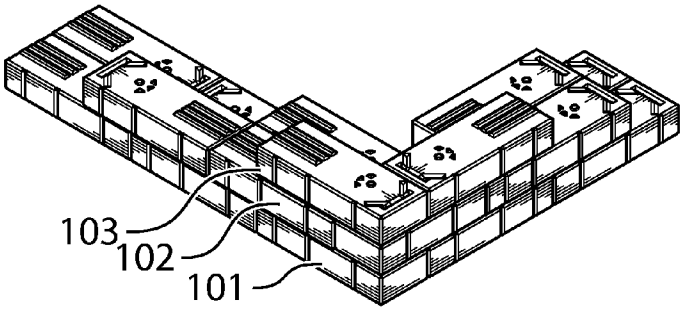
Figure 20:
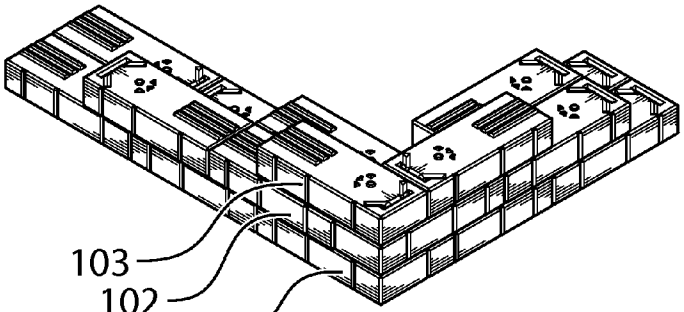

FIGS. 18-21 illustrate a 90° corner of a double wall arrangement, with various options of positioning layers 101, 102 and 103 with respect to each other. FIG. 19 illustrates a vertical arrangement of the layers. FIG. 18 illustrates layer 102 protruding between the layers 101 and 103, while FIG. 20 illustrates an opposite arrangement of layer 102 indented between the layers 101 and 103. FIG. 21 illustrates a setback arrangement of the layers. According to the design of the wall these and other layer arrangements, can be repeated or alternated.

FIG. 22 illustrates a double block (or dual block module) wall construction in which layer 102 is directly above layer 101 and layer 103 is setback from layer 102.

Figure 23:
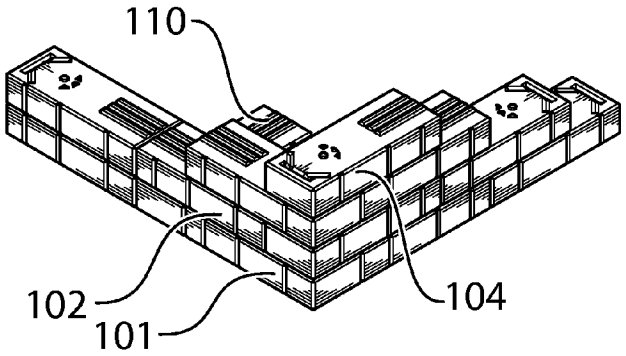

FIG. 23 illustrates a non-set back wall with a single tie-back block 110 and layer 101. In this instance, it is clear the standard staggering effect is used to construct the wall, and thus if desired, the recesses 35*a*, 35*b* and 35*c* of one block is never directly above or directly below the block of an adjacent layer.

Figure 24:
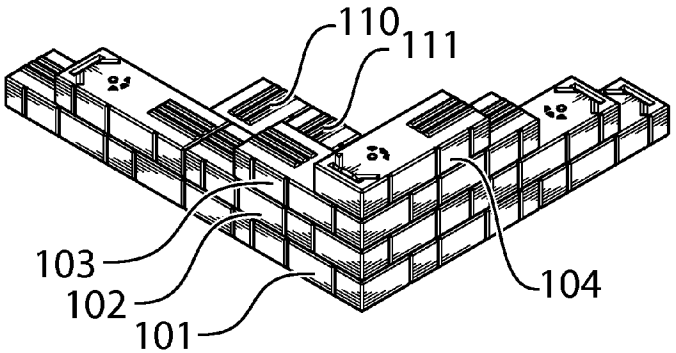

FIG. 24 illustrates a wall with two tie back blocks 110 and 111.

Figure 25:
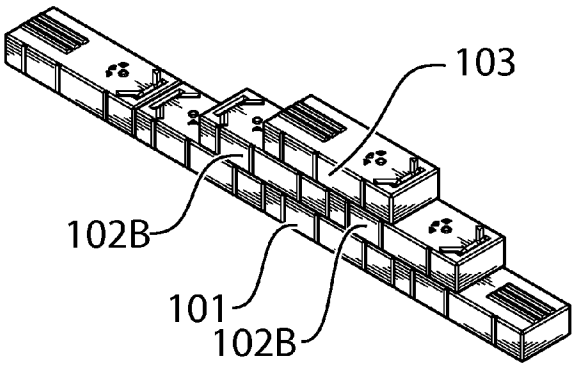

FIG. 25 illustrates a wall wherein layer 102 is partially set forward 102*a* and partially setback 102*b* relatively to layer 101.

Figure 27:
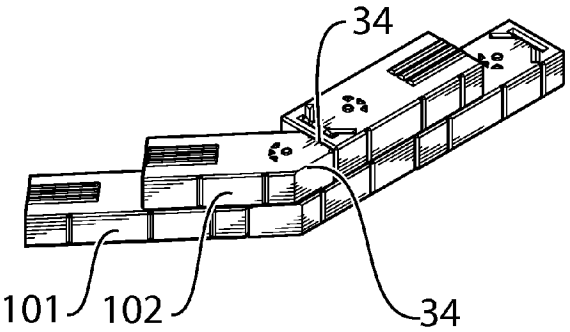
Figure 26:
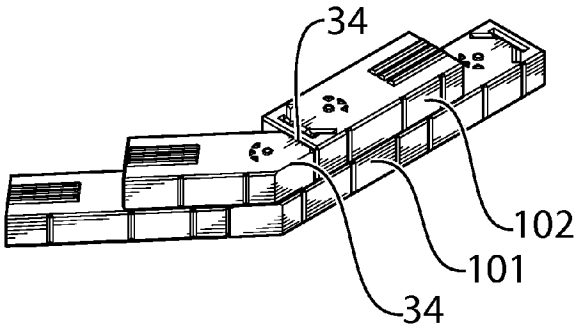
Figure 29:
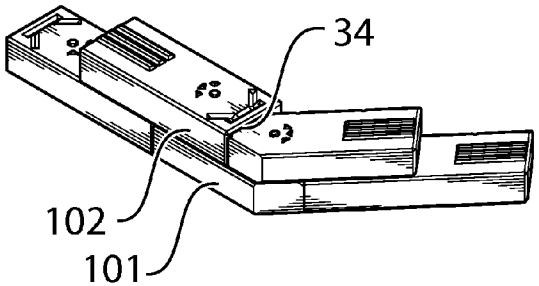

The block of FIG. 10 is used in the wall construction in FIGS. 26, 27 and 29 forming a 135° corner.

FIG. 26 depicts a set back of layer 102 in relation to layer 101.

FIG. 27 depicts no set back between the two layers and FIG. 29 depicts a set forward of layer 102 in relation to layer 101.

Figure 28:
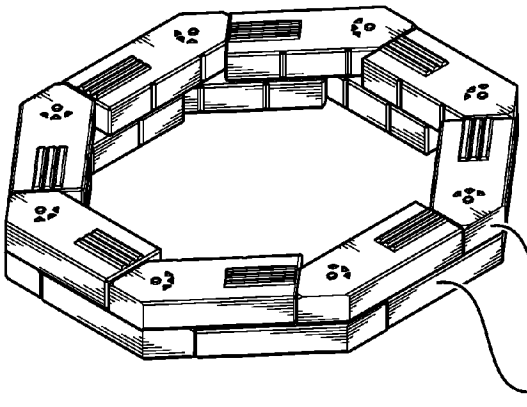

FIG. 28 depicts a substantially "circular" or octagon configuration two layer wall utilizing a plurality of the blocks depicted in FIG. 10 with the faces resulting from engaging the score lines are exposed outwardly.

Figure 30:
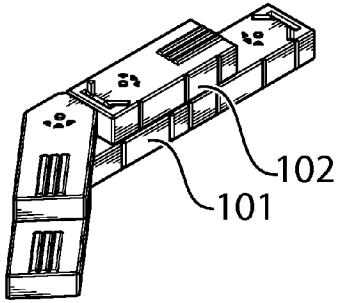

FIG. 30 is the opposite side view of FIG. 27.

Figure 31:
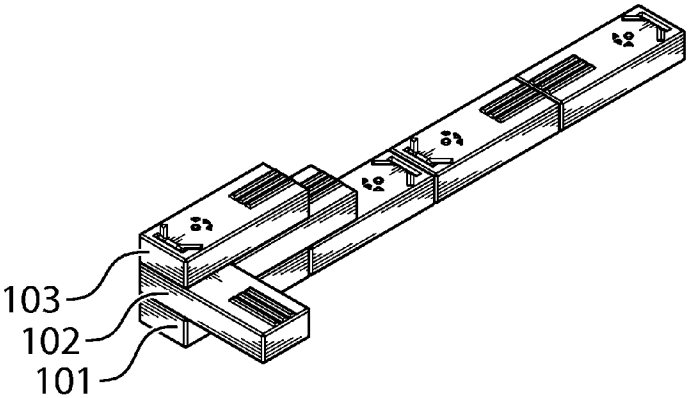

FIG. 31 depicts the construction of a wall formed of three layers. A bottom layer 101, a second layer 102 and a third layer 103, from the inside of the 90° angle corner.

Figure 32:
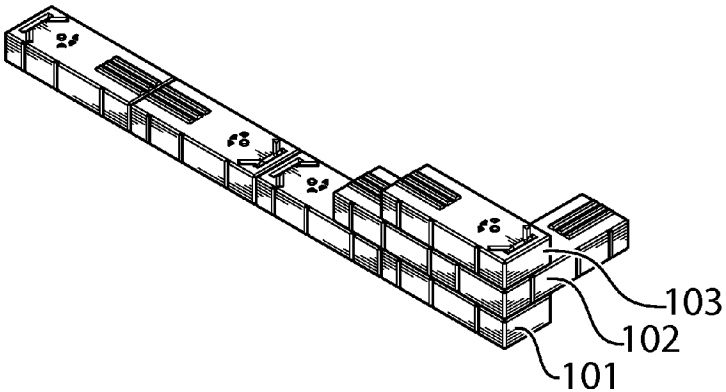

FIG. 32 depicts the construction of a corner of a setback wall with a 90° angle corner. It is clear that layer 103 is setback from layer 102 and layer 102 is setback from layer 101.

Figure 33:
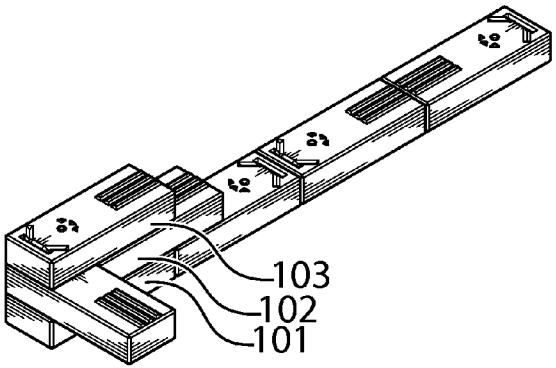

FIG. 33 depicts the construction of a wall formed of three layers. A bottom layer 101, a second layer 102 and a third layer 103, from the inside of the 90° inner corner angle. In this instance layer 103 is set forward from layer 102 which in turn is set forward from layer 101.

Figure 34:
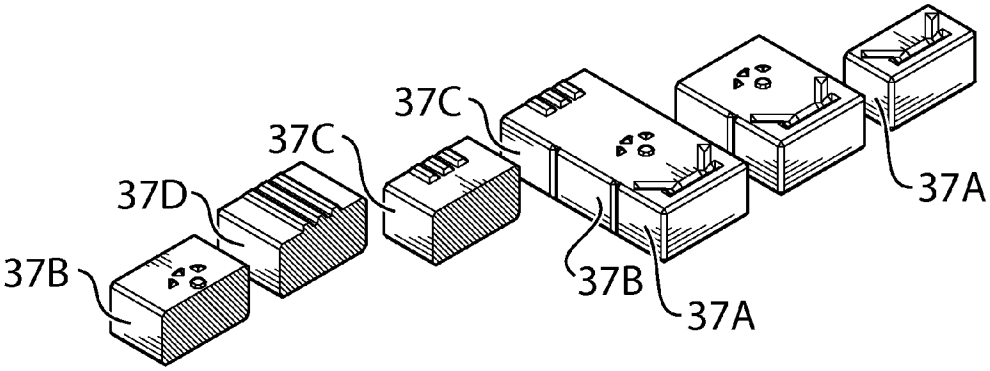
FIG. 34 illustrates several variants of smaller blocks derived from a single block of the present invention.

FIG. 34 illustrates six smaller blocks which may be manufactured from block 20 by separating it at the score lines 35*a*, 35*b* and 35*c* (see FIG. 2). The resulting smaller blocks have the same width of the original block 20 but different length. In the same way block 20' may be separated into smaller blocks different in length but same original width. As illustrated in FIGS. 2 and 4, score lines 35*a*, 35*b* and 35*c* on blocks 20 and 20' are not mirrored. Thus a smaller block when score line 35*a* is engaged, results in a smaller block with a wall 37*a* and score line 33; while the smaller block with a wall 37*a* made of block 20' would have three ribs 32*a*, 32*b* and 32*c* on the top 21. This way block fillers may be manufactured for construction of a wall of complex design.

As described above the bottom of the block comprises a segment 22' not crossed by the recesses 36. Thus while positioned on top of another block in a parallel manner, this segment 22' preferably is not positioned on top of the ribs 32 or projection zone 27. In one embodiment, this feature facilitates interlocking of the blocks as well as acts as a guide to encourage a staggered "joint" effect when at least two blocks are in substantially parallel (either vertical, set back or set forward) position. In this manner, at one position, the ribs 32 of the bottom block substantially abut segment 22' of the above positioned block. In another position, the ribs 32 of the bottom block do not substantially abut segment 22' of the above positioned block. In yet another embodiment, when substantially perpendicular, projection zone 27 of the bottom block substantially abuts segment 22'. In one embodiment, if removable segment 29 is removed, segment 22' will not be present. In another embodiment, if removable segment 29 is removed a portion of segment 22' will remain to substantially cover ribs 32 from view when used in construction.

Combining these options of producing more than 20 distinct smaller blocks from each block along with above listed larger than 20 different block positioning, gives a constructor a freedom of constructing a wall of various degrees of complexity according to his imagination. All these variants are possible due to the unique features of the versatile standard block described above.

Many changes can be made to the design of the blocks. For example, there may be only one directional projection 30 to support the angular direction of the blocks. Alternatively there may be three directional projections 31 without projection 30. In other embodiments there may be additional projections 31 positioned between projection 30 and the side 26. Alternatively there may be a matrix of directional projections assisting positioning the blocks in different directions.

With respect to the triangular shape of the projections 31, this shape facilitates positioning of the above located block with the recesses. However, in an alternative embodiment, these projections may have other forms. Such forms may include, but are not limited to round, hexagonal or other poly-angular form. These projections substantially matingly engage with recesses 36.

In yet another alternative embodiment, the projections 27 and the ribs 32 on top of the block 20 may be removable in order to provide a flat top surface 21 of block 20, if required. In yet another variant of the invention, the ribs 28 may also be replaced with directional projections 27 thus having a block with two sets of directional projections serving as lateral supports as well.

It is easy to see that the blocks may be easily laid on top of one another; they also may be positioned in front set position or set back position relative to each other. The blocks may be positioned parallel, perpendicular, angled at 45° or 135°, angled and set back, perpendicular and set back just to name a few of the combinations. Although the structures depicted may only consist of one, two or three layers of blocks, any number of layers of blocks may be used within the spirit of the invention. From reviewing the non-limiting examples it is apparent that the block of the present invention allows construction of walls of various complex designs allowing the builder/designer a high degree of freedom.

The versatility of the block of the present invention gives a wide selection of forms to retaining wall design and construction. And the fact that same block can be used for wall construction, corner construction, round shapes and fillers, makes the construction process cost efficient and straight forward.

As many changes can be made to the embodiments of the invention without departing from the scope of the invention, it is intended that all material herein be interpreted as illustrative of the invention and not in a limiting sense.

What is claimed is:

1. A block for forming a structure, said block comprising a top, a bottom, a front wall, a back wall and two side walls, said block having disposed proximate the top at least two longitudinal projections, said block having disposed proximate the bottom thereof at least one recess, wherein when the structure is formed from a plurality of said blocks, at least one of said longitudinal projections of one block engages with said at least one recess of another block wherein the top of the block further comprises two zones, a lateral zone, and a corner zone; said lateral zone further comprises said at least two longitudinal projections permitting an above positioned block to be placed generally laterally parallel to said block;

wherein the corner zone comprises at least one directional projection permitting placement of an above positioned block in a substantially parallel placement; in a substantially angular placement; and in a substantially perpendicular placement.

2. The block of claim 1 wherein the corner zone further comprises a plurality of directional projections, wherein during placement of an above positioned block, at least one recess of the above positioned block engages with at least one of said directional projections in at least one of the following:

in a substantially parallel placement at least one recess engages at least one directional projection;

in an substantially angular placement at least one recess engages at least one directional projection; and in a substantially perpendicular placement at least one recess engages at least one directional projection.

3. The block of claim 1 wherein the corner zone further comprises at least one removable segment defined by at least one score line, wherein upon the removal of said removable segment by engagement of said at least one score line the block:

i) is reduced in length; and/or ii) is reduced by at least one corner thereof; and/or iii) is reduced at both corners thereof;

and/or combinations thereof.

4. The block of claim 1 wherein at least one of said at least two longitudinal projections is an elongated rib and said at least one directional projection is selected from a substantially triangular projection, a substantially hexagonal projection, a substantially octagonal projection, a substantially poly-angular projection, a round projection and combinations thereof.

5. A building block having a top and a bottom, and four side walls, the bottom comprising a plurality of substantially parallel recesses, the top comprising a lateral zone and a corner zone, the lateral zone further comprising a plurality of substantially parallel projections for matingly receiving into said parallel recesses of an above placed block, said corner zone comprising a plurality of directional projections for matingly receiving into at least one of the substantially parallel recesses of an above positioned block, while positioning said above positioned block perpendicular to, at substantially 45° to, or at substantially 135° to said building block, further the corner zone comprises at least one removable segment defined by at least one score line.

6. The building block of claim 5 wherein at least one of the walls further comprises at least one recess defining at least one removable segment for separating said block into at least two blocks.

7. The building block of claim 5 wherein said block comprises a plurality of removable segments defined by a plurality of score lines respectively.

8. The building block of claim 5 wherein said substantially parallel projections for matingly receiving into said parallel recesses of an above positioned block comprise substantially parallel ribs, and said plurality of directional projections are selected from substantially triangular projections, substantially hexagonal projections, substantially octagonal projections, substantially poly-angular projections, round projections and combinations thereof.

9. A mortarless retaining wall formed from a plurality of building blocks of claim 6.

10. A dual-block module comprising two blocks of claim 1 having adjacent faces joined together proximate at least one score line.

11. A construction block comprising a top, a bottom, a front wall, a substantially smooth back wall, a left wall and a right wall, wherein:

the top comprises:

a) three longitudinal projections extending from said left wall of the toward said right end, b) proximate said right wall of the block, said top has three score lines: a first score line running substantially parallel to said right wall and two score lines substantially 45° to said first score line, the first score line allows removal of the smooth right wall creating a shorter block, and said two other score lines substantially 45° to said first score line allow removal of one or two of the corners proximate said right wall of the block;

c) said top further comprises directional projections positioned between the score lines and the longitudinal projections of the block, said directional projections allow positioning of an above positioned block, in a parallel, perpendicular, substantially 45° or substantially 135° angular relation to a bottom positioned block, the bottom of the block comprises:

a plurality of longitudinal recesses adapted to receive corresponding said longitudinal projections on the top of a bottom positioned block, the longitudinal recesses extending from the left wall of the block proximate the right wall of the block;

the substantially smooth back wall of said block comprises:

a plurality of substantially vertical score lines along the wall, for optional separation of the block into a plurality of shorter blocks.

12. The construction block of claim 11 wherein said three longitudinal projections comprise substantially parallel ribs, and said directional projections are selected from substantially triangular projections, substantially hexagonal projections, substantially octagonal projections, substantially polyangular projections, round projections and combinations thereof.

13. A mortarless retaining wall formed from a plurality of blocks of claim 1.

14. A mortarless retaining wall formed from a plurality of building blocks of claim 5.

15. A mortarless retaining wall formed from a plurality of blocks of claim 11.

16. A dual-block module comprising two blocks of claim 1, the module having adjacent faces joined together proximate at least one score line.

17. A dual-block module comprising two building blocks of claim 5, the module having adjacent faces joined together proximate at least one score line.

18. A dual-block module comprising two blocks of claim 11, the module having adjacent faces joined together proximate at least one score line.

* * * * *